US008763837B2

(12) United States Patent
Awada et al.

(10) Patent No.: US 8,763,837 B2
(45) Date of Patent: Jul. 1, 2014

(54) COLLECTION RECEPTACLES FO GASES

(76) Inventors: Salam Awada, Logan, UT (US); Paul Manning, Logan, UT (US); Rex Spendlove, Millville, UT (US)

( * ) Notice: Subject to any disclaimer, the term of this patent is extended or adjusted under 35 U.S.C. 154(b) by 0 days.

(21) Appl. No.: 13/601,657

(22) Filed: Aug. 31, 2012

(65) Prior Publication Data

US 2012/0325686 A1 Dec. 27, 2012

Related U.S. Application Data

(63) Continuation of application No. 12/546,658, filed on Aug. 24, 2009.

(60) Provisional application No. 61/189,784, filed on Aug. 23, 2008.

(51) Int. Cl.

| | |
|---|---|
| ***B65D 88/34*** | (2006.01) |
| ***B65D 88/38*** | (2006.01) |
| ***B65D 88/78*** | (2006.01) |
| ***C10L 3/08*** | (2006.01) |

(52) U.S. Cl.

CPC ..... *C10L 3/08* (2013.01); *F17C 2205/0169* (2013.01); *F17C 2203/0617* (2013.01); *F17C 2270/0102* (2013.01); *F17C 2201/054* (2013.01); *F17C 2201/056* (2013.01); *F17C 2201/0157* (2013.01); *F17C 2203/066* (2013.01)

USPC ..... 220/216; 220/219; 114/256

(58) Field of Classification Search

USPC ..... 220/216–220, 560, 227; 48/127.3, 48/127.5; 210/603; 96/155, 220, 159; 114/256; 137/202; 4/498, 499, 503

See application file for complete search history.

(56) References Cited

U.S. PATENT DOCUMENTS

| | | | | |
|---|---|---|---|---|
| 1,674,039 | A * | 6/1928 | Glass | 220/218 |
| 3,774,799 | A * | 11/1973 | Heisterberg | 220/216 |
| 4,122,561 | A * | 10/1978 | Barr | 4/499 |
| 4,366,806 | A * | 1/1983 | Acker | 126/565 |
| 5,562,090 | A * | 10/1996 | Katz | 126/198 |
| 5,740,562 | A * | 4/1998 | Nickalo | 4/504 |
| 6,851,891 | B2 * | 2/2005 | Baumgartner et al. | 405/129.9 |
| 2008/0226859 | A1 * | 9/2008 | Manning et al. | 428/53 |

* cited by examiner

*Primary Examiner* — Bryon Gehman
*Assistant Examiner* — Shawn M Braden
(74) *Attorney, Agent, or Firm* — Project CIP; Preston P. Frischknecht

(57) ABSTRACT

A gas collection receptacle includes a segmented top portion and one or more side portions creating a volume for collecting gases. The gas collection receptacle, configured to float on a pond, lagoon, or other area, also includes interlocking side and end portions enabling multiple receptacles to connect, thus forming a substantially continuous covering.

14 Claims, 7 Drawing Sheets

COLLECTION RECEPTACLES FO GASES

CROSS-REFERENCE TO RELATED APPLICATIONS

This application is a continuation-in-part of application Ser. No. 12/546,658 and claims priority to U.S. Provisional Patent Application No. 61/189,784, filed Aug. 23, 2009, which is incorporated herein by reference.

BACKGROUND OF THE INVENTION

1. The Field of the Invention

This invention relates generally to collection of gaseous byproducts. More specifically, embodiments of the present invention relate to collection receptacles for the collection of methane produced by lagoons, ponds, lakes, wells, and other retention facilities.

2. Related Technology

Many industrial operations and municipalities use ponds, lagoons, and other retention areas for detention and retention of waste materials collected over time. These ponds, lagoons, and retention areas include, for example, sewage lagoons, ponds where animal waste such as manure is collected, and landfills. Such areas, when left uncovered, release polluting gases into the atmosphere. Certain other fluid retention areas, such as natural gas wells on land and in the ocean, swampy areas, and other ponds and lakes that contain high concentrations of organic matter, also release polluting gases when left uncovered. These polluting gases, or byproducts, are often harmful to the environment and detrimental to air quality.

Two of the byproducts commonly released from these retention areas are ammonia and methane. Ammonia may be released into the atmosphere during the process of managing manure produced by abattoirs and other cattle-related industries. For example, manure is often treated by windrowing the manure, which is then digested aerobically. While this aerobic digestion produces solids that can be sold as soil compost, aeration of windrows during the digestion process can release substantial amounts of ammonia into the air, thus negatively affecting air quality.

Like ammonia, methane is commonly released from waste containment lagoons and ponds, and other sources, directly into the atmosphere. Unlike ammonia, however, methane has many uses, some of which deserve particular consideration considering the current energy crisis, particularly because methane is a viable energy source that can be used in motorized vehicles and other applications. Thus, methane has an economic value making the collection of methane more attractive to industries and municipalities. Because the United States produces large amounts of animal manure each year (estimates put U.S. production of animal manure at between 1.4 and 2 trillion pounds), conversion of animal waste to methane by anaerobic digestion, and subsequent collection of methane, could provide immeasurable economic and energy benefits.

In order to mitigate the effects of releasing methane directly into the atmosphere, certain products for containing methane over ponds and lagoons have been developed. For example, manure digestion ponds may be covered with a heavy tarp anchored to a concrete strip that surrounds the pond. Unfortunately, such tarp systems are expensive, heavy, and cumbersome, and placement and removal of such systems is labor intensive.

What is needed are systems that provide large collection vessels that can be used to collect methane from waste ponds and other areas, and to prevent gaseous emissions from exiting such areas directly into the atmosphere.

BRIEF SUMMARY OF THE INVENTION

Embodiments of the present invention include plastic gas collection receptacles configured to contain gases emitted from ponds, lagoons, and other areas. Gas collection receptacles of the present invention are lightweight and easy to place and remove, as needed. The gas collection receptacles also incorporate an interlocking design to allow multiple collection receptacles to fit together securely over a ponds or lagoon. Moreover, the gas collection receptacles of the present invention allow gases to be removed from the receptacles for use in a variety of applications.

These and other aspects of the present invention will become more fully apparent from the following description and appended claims, or may be learned by the practice of the invention as set forth hereinafter.

BRIEF DESCRIPTION OF THE DRAWINGS

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings are not drawn to scale. The invention will be described and explained with additional specificity and detail through the use of the accompanying drawings in which.

DETAILED DESCRIPTION OF EXEMPLARY EMBODIMENTS

Embodiments of the present invention include receptacles for collection and containment of methane and other gases. In one embodiment of the invention, receptacles are configured to cover ponds, lagoons, and other sources of methane and other gases. The methane and other gases are retained within the receptacle and can be collected from the receptacle for use or disposal.

Figure 1:
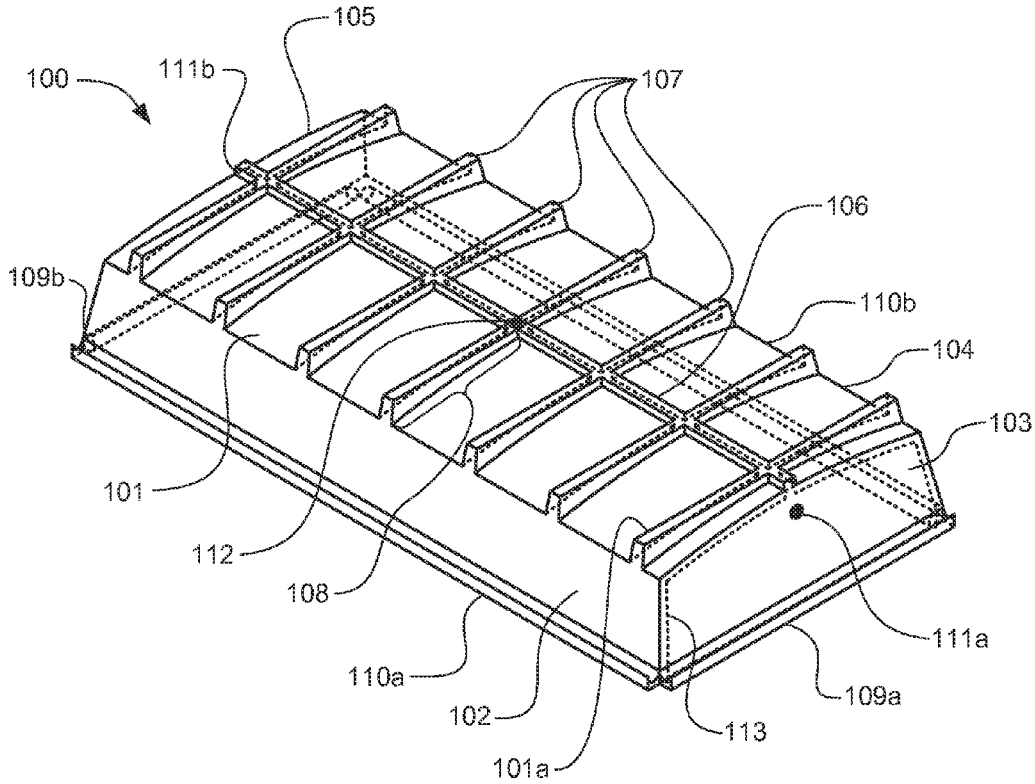
FIG. 1 shows an isometric view of one embodiment of a gas collection receptacle.

With attention now to FIG. 1, an isometric view of gas collection receptacle 100 is shown. In one embodiment of the invention, gas collection receptacle 100 has a modified rectangular shape with rounded top end edges. Top portion 101 connects to a first side portion 102, second side portion 104, first end portion 103, and second end portion 105, which, in turn, hold top portion 101 a certain distance up from the surface of the pond, lagoon, or other area, thereby creating a receptacle 100 having a certain interior volume for gas collection. Embodiments of the present invention include receptacles 100 having any length and/or width.

Figure 3:
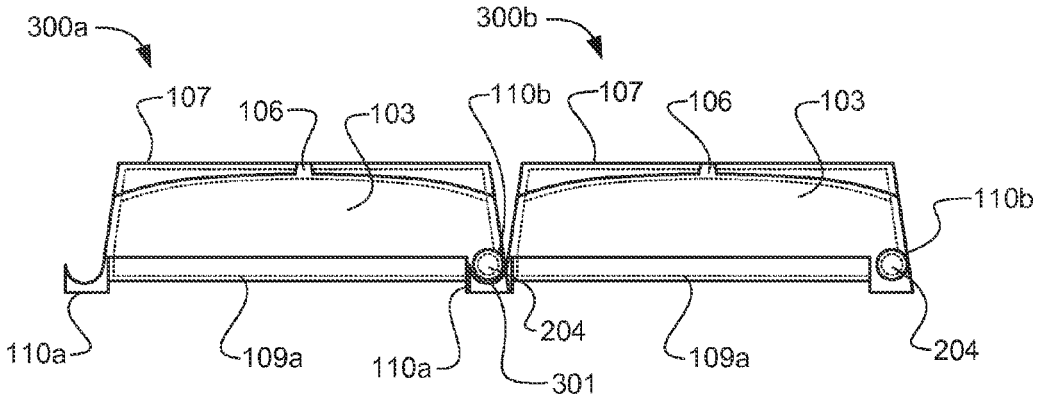
FIG. 3 shows an end view of one embodiment of connecting gas collection receptacles.

In addition, the top portion 101 of the receptacle 100 may include a fishbone structure 101*a* across the top portion 101 having a longitudinal ridge 106 perpendicular and connected to a plurality of lateral ridges 107. Various embodiments of the invention may include one or more fishbone structures of other configurations on the top portion 101, or other structures having longitudinal and/or lateral ridges, without departing from the scope of the invention. In various embodiments, the fishbone 101*a* or other structure may form a substantially planar and intermittent top surface (see FIG. 3) of the top portion 101.

A concave shape is also present in the interior of the receptacle, as shown by contour line 113. On the interior of the receptacle 100, this concave shape 113 assists in the separation of gases of differing weights by forming an inverse funnel within the receptacle 100, thereby facilitating movement of the lightest gases towards various apertures. The fishbone structure 101*a* and concave shape 113 provide strength to the receptacle 100 such that the receptacle 100 may support the weight of a person without collapsing.

In addition to ridges 106 and 107, receptacle 100 includes end connectors 109*a*, 109*b* and side connectors 110*a*, 110*b*. These connectors are configured to releasably attach to similarly configured receptacles, as described in more detail below. In one embodiment of the invention, receptacle 100 also includes one or more apertures 111*a*, 111*b* (not shown), and/or 112, which extend from the interior of the receptacle to the exterior of the receptacle for facilitating the removal or exit of methane and/or other accumulated gases from the interior of the receptacle 100. These receptacles are in communication with the interior volume of the receptacle 100. For example, in the illustrated embodiment, the receptacle 100, includes a first end portion aperture 111*a* located at the first end portion 103 adjacent to the top 101, a second end portion aperture 111*b* located at the second end portion 105 adjacent to the top, and a top aperture 112 located on the top portion 101.

Figure 2:
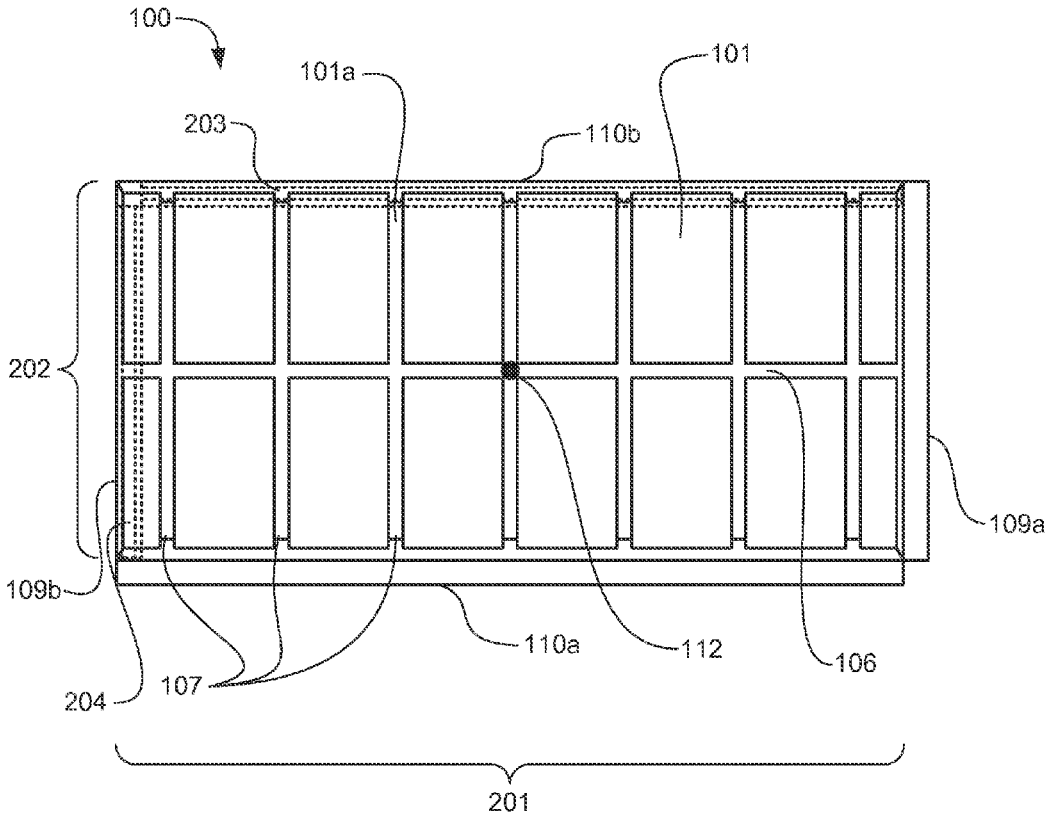
FIG. 2 shows a top view of one embodiment of a gas collection receptacle.

With attention now to FIG. 2, a top view of receptacle 100 is shown. The fishbone structure 101*a* has longitudinal ridge 106 that extends along the length 201 of the top portion 101 of the receptacle 100, and lateral ridges 107, extending across the width 202 of the top portion 101 of the receptacle 100. Further, receptacle 100 includes side portion connectors 110*a*, 110*b* and end portion connectors 109*a*, 109*b*.

In one embodiment of the invention, first side portion connector 110*a* is located on one side of the receptacle and is an elongated, hooked shelf, generally extending along the length 201 of the receptacle 100. Second side portion 110*b* is located on the opposite side of the receptacle 100 and is an elongated rounded shelf, also generally extending along the length 201 of the receptacle 100. Side portion connectors 110*a* and 110*b* are releasably interlocking side portions configured to interlock with side portions of other receptacles when the receptacles are placed adjacent each other in a side-by-side position. For example, referring briefly to FIG. 3, identical first 300*a* and second 300*b* receptacles are shown releasably interlocked. A hooked shelf side portion connector 110*a* of the second receptacle 300*b* is interlocked 301 with the rounded shelf side connector 110*b* of the first receptacle 300*a*.

Figure 4:
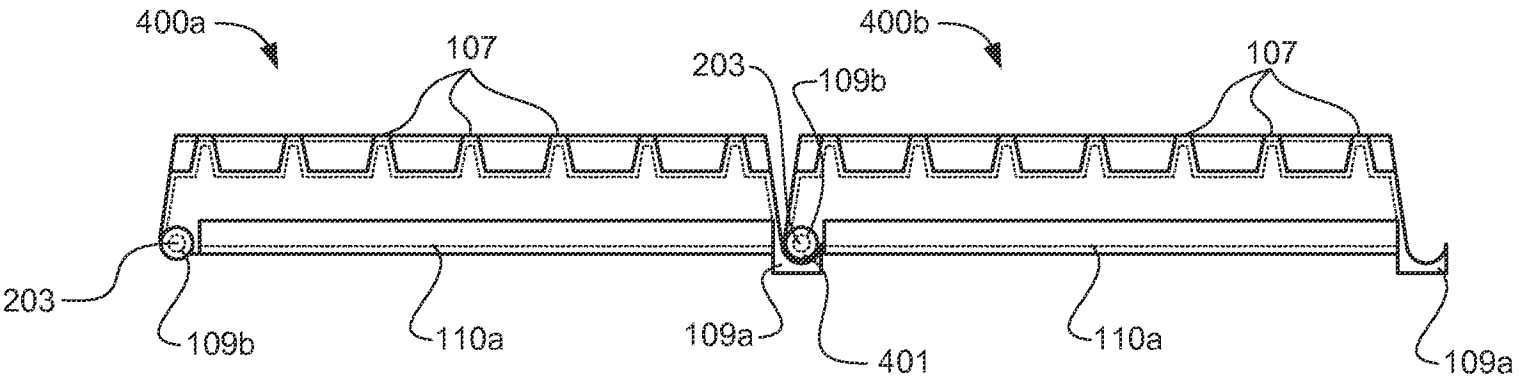
FIG. 4 shows a side view of one embodiment of connecting gas collection receptacles.

Referring back to FIG. 2, in one embodiment of the invention, end portion connectors 109*a* and 109*b* are also similarly configured to releasably interlock end portions of other receptacles when two or more receptacles are placed adjacent each other in an end-to-end configuration. First end portion connector 109*a* is located on one end of the receptacle 100 and is an elongated, hooked shelf, generally extending along the width 202 of the receptacle 100. Second end portion connector 109*b* is located on the opposite end of the receptacle 100 and is an elongated rounded shelf, generally extending along the width 202 of the receptacle 100. Referring briefly to FIG. 4, identical first 400*a* and second 400*b* receptacles are shown releasably interlocked. A hooked shelf end portion connector 109*a* of the first receptacle 400*a* is interlocked 401 with the rounded shelf side connector 109*b* of the second receptacle 400*b*.

In various embodiments, because side and end connectors of receptacles are configured to releasably connect with side and end connectors of other receptacles, the receptacles may be releasably attached side-by-side and end-by-end to create a network of receptacles across a gas-generating environment such as a pond or pool, as described in more detail below. (See FIGS. 6 and 7).

Referring again to FIG. 2, certain embodiments of the invention may include features within the receptacle 100 for enhanced flotation of the receptacle 100 on liquid surface environments. For example, enhanced features for flotation may include one or more hollow and/or porous portions within one or more connectors. In the illustrated embodiment, a first hollow and/or porous portion 203 is shown within second side portion connector 110*b*, generally extending along the length of the receptacle 201 within the second side portion connector 110*b*. A second hollow and/or porous portion 204 is shown within the second end portion connector 109*b*, generally extending along the width 200 of the receptacle 100. In the illustrated embodiments, hollow and/or porous portions form a complete perimeter of enhanced flotation around each receptacle when that receptacle is releasably interlocked with other receptacles on all sides and ends. Of course, any number of enhanced features for flotation may be included without departing from the purpose and scope of the invention.

Figure 5:
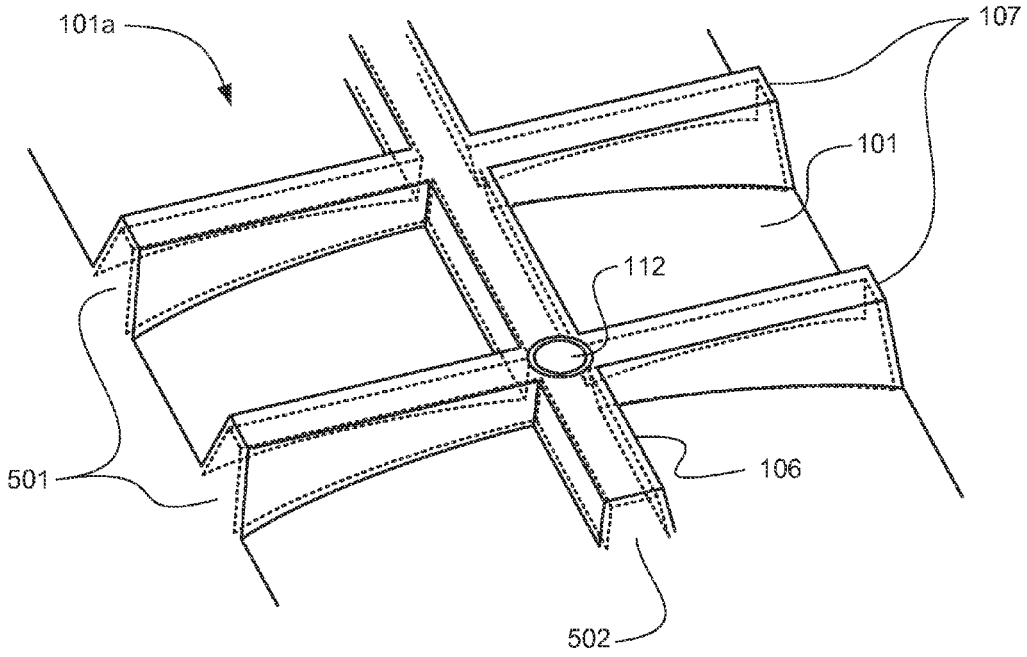
FIG. 5 shows a perspective view of one embodiment of channel features of a gas collection receptacle.

Referring now to FIG. 5, certain embodiments of the invention may include one or more sub-volumes 501, 502 within the interior of the receptacle 100 which form compartments for enhanced gas separation and collection in the upper interior portions of the receptacle. In the illustrated embodiment, these sub-volumes are located within the fishbone structure 101*a* of the receptacle 100. The plurality of lateral ridges 107 has interior recessed channels 501 located within the ridges, which are in fluid communication with the interior volume of the receptacle 100. Longitudinal ridge 106 may also have an interior recessed channel 502 located within the ridge, which is in fluid communication with the interior volume of the receptacle and/or other recessed channels (e.g., 501). When the collection receptacle is in operation, these recessed channels form interior compartments above the main interior volume of the receptacle and/or in the upper interior portions of the receptacle and form an area into which the lightest gases within the receptacle will occupy. First end portion aperture 111*a*, a second end portion aperture 111*b*, and/or top aperture 112 are generally located adjacent to the top portions of the interior of the receptacle, in communication with these sub-volumes, and thereby configured to allow for the preferential exit of the lightest gases from the receptacle 100.

In operation, receptacle 100 can be floated on ponds and lagoons to collect and retain methane. For example, receptacle 100 can be used to cover sewage lagoons, ponds where animal waste such as manure is digested anaerobically, garbage landfills, uncapped natural gas wells on land and in the ocean, swampy areas, and other ponds, lakes, and the like that contain high concentrations of organic matter. Receptacle 100 can be made of a variety of different materials, such as, for example, hard plastic (acrylonitrile butadiene styrene ("ABS") or polyvinyl chloride ("PVC")) or soft plastic. Configuration of receptacle 100 in this way creates a gas receptacle that is lightweight, relatively inexpensive to manufacture, and can be easily installed and removed from gas production locations such as those listed above.

In addition, multiple receptacles 100 may be used to cover a pond, lagoon, or other gas-producing area. When multiple receptacles are used to cover an area, interlocking end portions of one receptacle are configured to connection to interlocking end portions of another receptacle, and interlocking side portions of one receptacle are configured to connect to interlocking side portion of still another receptacle, thus effectively creating a stable, continuous covering or network over the area. In this way, receptacles 100 may be configured alone or in combination to create a continuous covering shaped to cover any area.

Figure 6:
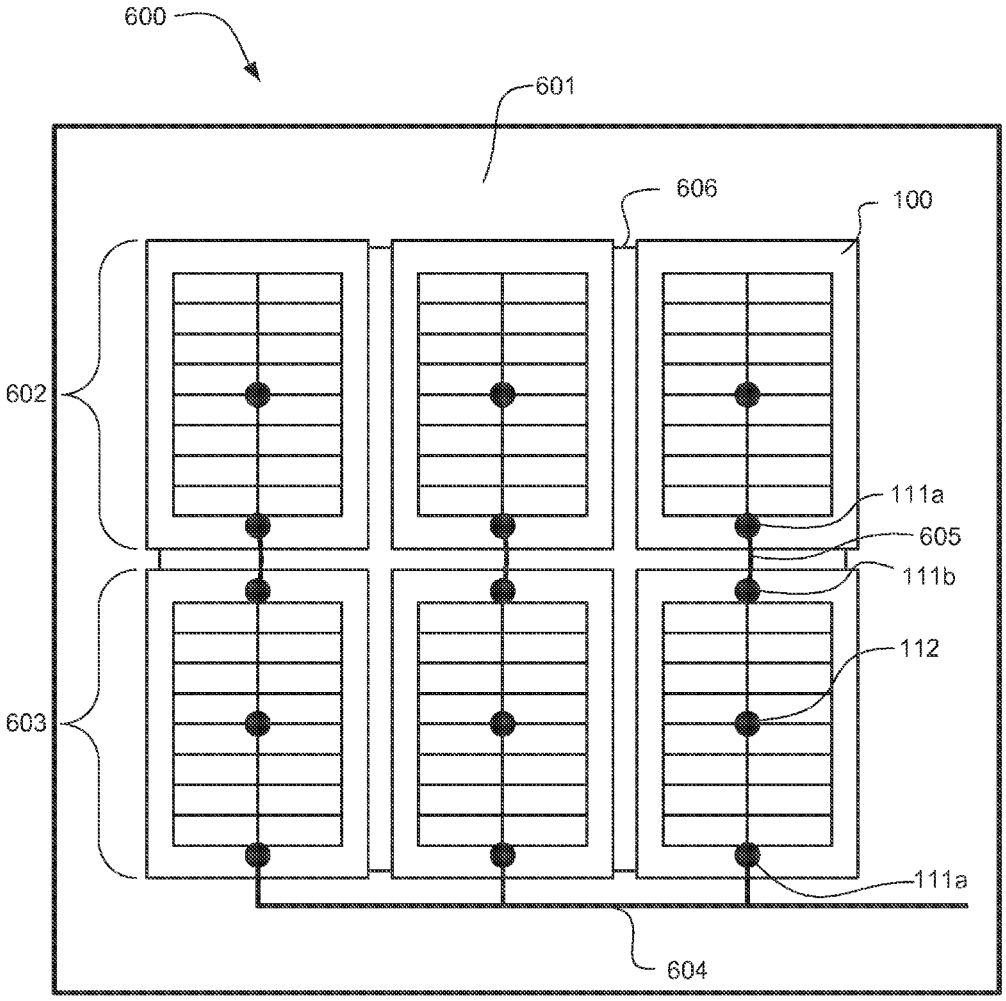
FIG. 6 shows a first embodiment of a network of interlocking gas collection receptacles.

Referring now to FIG. 6, a first network 600 of releasably interlocking receptacles is shown on a gas-generating environment 601 such as a pond or pool. Receptacles 100 are joined at interlocking portions 606. The interlocking portions 606 and receptacles 100 form a substantial barrier to gas escaping from the gas-generating environment 601, such that gases released from pond or pool surfaces are collected within the receptacles. In various embodiments, top and other apertures 112 may be closed. Gases collected within the receptacles of the network 600 are drawn from a first line 604 attached to each first end portion aperture 111*a* of each receptacle 100 in a first row 603 of receptacles in the network 600. A second row of receptacles 602 is in fluid communication with the first row of receptacles 603 through one or more secondary lines 605 between first 111*a* and second 111*b* end apertures, thereby allowing gases from the second row 602 to be drawn into the first row 603, and eventually through first line 604.

Figure 7:
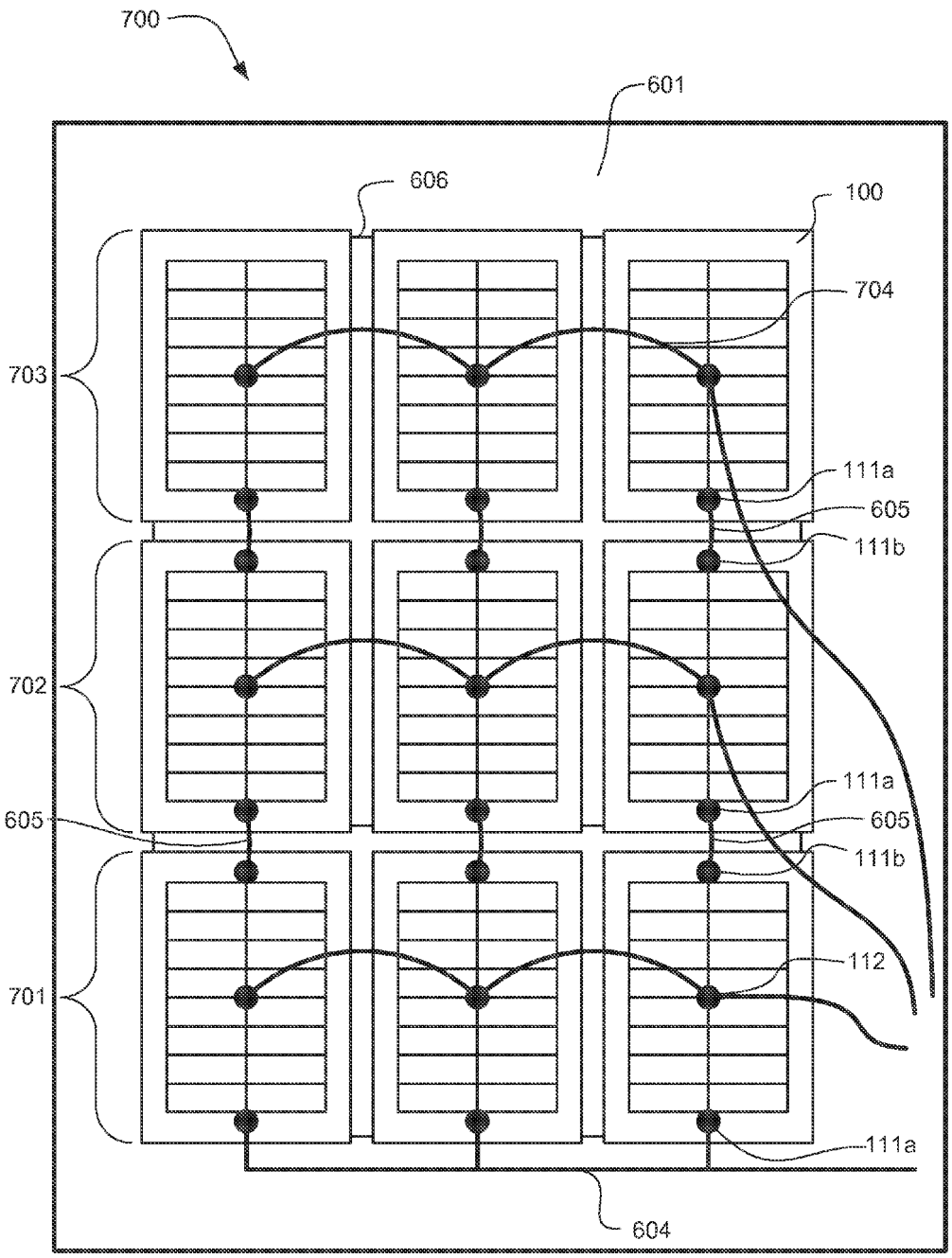
FIG. 7 shows a second embodiment of a network of interlocking gas collection receptacles.

Referring now to FIG. 7, a second network 700 of releasably interlocking receptacles is shown on a gas-generating environment 601 such as a pond or pool. Receptacles 100 are joined at interlocking portions 606. The interlocking portions 606 and receptacles 100 form a substantial barrier to gas escaping from the gas-generating environment 601, such that gases are collected within the receptacles. In various embodiments, certain apertures may be closed. Gases collected within the receptacles of the network 700 are drawn from a first line 604 attached to each first end portion aperture 111*a* of each receptacle 100 in a first row 701 of receptacles in the network 600. A second row of receptacles 702 is in fluid communication with the first row of receptacles 701 through one or more secondary lines 605 between first 111*a* and second 111*b* end apertures, thereby allowing gases from the second row 702 to be drawn into the first row 701, and eventually through first line 604. A third row of receptacles 703 is in fluid communication with the second row of receptacles 702 through one or more secondary lines 605 between first 111*a* and second 111*b* end apertures, thereby allowing gases from the third row 703 to be drawn into the second 702 and/or first rows 701, and eventually through first line 604. Tertiary lines 704 may connect to the top apertures 112 in one or more receptacles and/or rows in order to assist in drawing gases from the receptacles and/or larger network 700.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A substantially rectangular gas collection receptacle, comprising:

a top portion with first and second side and first and second end portions attaching to the top portion and thereby forming an interior volume, the interior volume of the receptacle having a concave shape that forms an inverse funnel within the receptacle to assist in the collection of gasses;

a fishbone structure located on the top portion of the receptacle, the structure having a longitudinal ridge generally extending along a length of the receptacle, and further perpendicular and connected to a plurality of lateral ridges which generally extend along the width of the receptacle, the structure further forming a substantially planar and intermittent top surface of the top portion;

a first side connector located on the first side of the receptacle, and a second side connector located on the second and opposite side of the receptacle, the first side connector being an elongated hooked shelf, generally extending along said length of the receptacle, and configured to releasably interlock with a rounded shelf side connector of another receptacle, and the second side connector being an elongated rounded shelf, also generally extending along said length of the receptacle, and configured to interlock with an elongated hooked shelf side connector of another receptacle; and a first end connector located on the first end of the receptacle, and a second end connector located on the second and opposite end of the receptacle, the first end connector being an elongated hooked shelf, generally extending along the width of the receptacle, and configured to releasably interlock with a rounded shelf side connector of another receptacle, and the second side connector being an elongated rounded shelf, also generally extending along said length of the receptacle, and configured to interlock with an elongated hooked shelf side connector of another receptacle;

wherein the connectors allow two or more collection receptacles to be arranged by positioning the receptacles in any side-by-side or end-to-end arrangement and engaging the interlocking connectors of the side by side-by-side or end-to-end receptacles to create a continuous covering that can be configured to substantially cover the surface of any area;

the receptacle being further configured to collect gases emitted from the surface of waste deposit sites, bodies of water, and areas containing relatively high concentrations of organic matter.

2. The gas collection receptacle as recited in claim 1, further having one or more hollow portions within one or more connectors for enhanced flotation of the receptacle on liquid surface environments.

3. The gas collection receptacle as recited in claim 1, further having one or more porous portions within one or more connectors for enhanced flotation of the receptacle on liquid surface environments.

4. The gas collection receptacle as recited in claim 1, further having one or more apertures which extend from the exterior of the receptacle to the interior of the receptacle to facilitate the exit of methane and/or other accumulated gases from the interior of the receptacle.

5. The gas collection receptacle as recited in claim 1, further comprising one or more sub-volumes within the interior of the receptacle which form a compartment for enhanced gas separation and collection, the sub-volumes located within the fishbone structure of the receptacle, and being comprised of recessed channels within the ridges, the channels being in fluid communication with the interior volume of the receptacle.

6. A substantially rectangular gas collection receptacle, comprising:

a top portion with first and second side and first and second end portions attaching to the top portion and thereby forming an interior volume, the interior volume of the receptacle having a concave shape that forms an inverse funnel within the receptacle to assist in the collection of gasses;

a fishbone structure located on the top portion of the receptacle, the structure having a longitudinal ridge perpendicular and connected to a plurality of lateral ridges, the structure further forming a substantially planar and intermittent top surface of the top portion; the structure further having recessed channels within the ridges, the channels being in fluid communication with the interior volume of the receptacle, and the channels forming one or more compartments for collecting gasses in an upper interior portion of the receptacle;

a first side connector located on the first side of the receptacle, and a second side connector located on the second and opposite side of the receptacle, the first side connector being an elongated hooked shelf, generally extending along a length of the receptacle, and configured to releasably interlock with a rounded shelf side connector of another receptacle, and the second side connector being an elongated rounded shelf, also generally extending along said length of the receptacle, and configured to interlock with an elongated hooked shelf side connector of another receptacle, the second side connector also having one or more hollow portions within the second side connector, generally extending along said length of the receptacle, for enhanced flotation of the receptacle; and a first end connector located on the first end of the receptacle, and a second end connector located on the second and opposite end of the receptacle, the first end connector being an elongated hooked shelf, generally extending along the width of the receptacle, and configured to releasably interlock with a rounded shelf side connector of another receptacle, and the second side connector being an elongated rounded shelf, also generally extending along said length of the receptacle, and configured to interlock with an elongated hooked shelf side connector of another receptacle, the second side connector also having one or more hollow portions within the second side connector, generally extending along said length of the receptacle, for enhanced flotation of the receptacle;

wherein the connectors allow two or more collection receptacles to be arranged by positioning the receptacles in any side-by-side or end-to-end arrangement and engaging the interlocking connectors of the side by side-by-side or end-to-end receptacles wherein interlocking portions and receptacles create a continuous covering that can be configured to substantially cover the surface of any area;

the receptacle being further configured to collect gases emitted from the surface of waste deposit sites, bodies of water, and areas containing relatively high concentrations of organic matter.

7. The gas collection receptacle as recited in claim 6, further having a first end portion aperture located at the first end portion adjacent to the top portion of the receptacle, the first end portion aperture extending from the exterior of the receptacle to the interior of the receptacle, the first end portion aperture configured to allow the exit of gasses from the interior of the receptacle.

8. The gas collection receptacle as recited in claim 6, further having a second end portion aperture located at the second end portion adjacent to the top portion of the receptacle, the second end portion aperture extending from the exterior of the receptacle to the interior of the receptacle, the second end portion aperture configured to allow the exit of gasses from the interior of the receptacle.

9. The gas collection receptacle as recited in claim 6, further having an aperture for exiting gas, the aperture located at an end, adjacent to the top portion of the receptacle, such that lightest gasses collected within the receptacle are exited first.

10. The gas collection receptacle as recited in claim 6, further having a top aperture located on the top portion, the top aperture extending from the exterior of the receptacle to the interior of the receptacle, the top aperture configured to allow the exit of gasses from the interior of the receptacle.

11. The gas collection receptacle as recited in claim 6, wherein the receptacle is configured of a soft plastic.

12. The gas collection receptacle as recited in claim 6, wherein the receptacle is configured of one of: acrylonitrile butadiene styrene ("ABS"); or, polyvinyl chloride ("PVC").

13. The gas collection receptacle as recited in claim 6, further located within a network of similarly configured receptacles, the receptacle in fluid communication with the similarly configured receptacles through one or more lines that allow movement of gas among the various receptacles.

14. The gas collection receptacle as recited in claim 6, wherein the hollow portions form a complete perimeter of enhanced flotation around each receptacle when each receptacle is releasably interlocked with other receptacles on all sides and ends.

* * * * *